US011719046B2

(12) United States Patent
Raymond

(10) Patent No.: US 11,719,046 B2
(45) Date of Patent: Aug. 8, 2023

(54) BALL TRANSFER MECHANISM WITH POLYCRYSTALLINE DIAMOND BEARING SUPPORT

(71) Applicant: National Technology & Engineering Solutions of Sandia, LLC, Albuquerque, NM (US)

(72) Inventor: David W. Raymond, Edgewood, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 18 days.

(21) Appl. No.: 17/190,881

(22) Filed: Mar. 3, 2021

(65) Prior Publication Data

US 2021/0207437 A1 Jul. 8, 2021

Related U.S. Application Data

(62) Division of application No. 15/726,506, filed on Oct. 6, 2017, now Pat. No. 10,968,700.

(51) Int. Cl.

| | |
|---|---|
| ***E21B 4/10*** | (2006.01) |
| ***E21B 17/07*** | (2006.01) |
| ***E21B 19/086*** | (2006.01) |
| ***E21B 21/01*** | (2006.01) |
| *E21B 4/02* | (2006.01) |
| *B06B 1/18* | (2006.01) |
| *F01B 1/06* | (2006.01) |

(52) U.S. Cl.
CPC ..... *E21B 4/10* (2013.01); *E21B 17/076* (2013.01); *E21B 19/086* (2013.01); *E21B 21/01* (2013.01); *B06B 1/183* (2013.01); *E21B 4/02* (2013.01); *F01B 1/0644* (2013.01)

(58) Field of Classification Search
CPC ... E21B 4/10; E21B 1/00; E21B 10/00; E21B 3/00; E21B 6/00; E21B 12/00
See application file for complete search history.

(56) References Cited

U.S. PATENT DOCUMENTS 5,396,965 A 3/1995 Hall et al.
10,100,850 B1 10/2018 Raymond
(Continued)

FOREIGN PATENT DOCUMENTS

GB 1035128 A * 7/1966

*Primary Examiner* — Chelsea E Stinson
(74) *Attorney, Agent, or Firm* — Daniel J. Jenkins

(57) ABSTRACT

A ball transfer mechanism for a harmonic drive and linear piston motor is disclosed. The ball transfer mechanism includes a spherical ball and a cylindrical seat portion. The seat portion defines a hemispherical shaped recess with a contour for receiving the ball. The ball transfer mechanism is in an exterior wall of a housing for converting rotary motion to linear motion, driving a linear piston motor. The harmonic drive drives a rotor of the linear piston motor. The harmonic drive includes a hollow cylindrical coupler portion engaging a rotor portion for transferring torque to the rotor portion. Transfer mechanisms disposed along a housing wall of the linear piston motor engage the coupler portion. The coupler portion includes harmonic cam grooves for receiving spherical balls in the ball transfer mechanism that drives rotational motion in the rotor in response to axially linear movement of the piston assembly.

13 Claims, 3 Drawing Sheets

(56) References Cited

U.S. PATENT DOCUMENTS

| | | | |
|---|---|---|---|
| 2009/0236387 | A1 | 9/2009 | Simonelli et al. |
| 2012/0132453 | A1 | 5/2012 | Fu |
| 2019/0107127 | A1 | 4/2019 | Raymond |
| 2019/0128391 | A1 | 5/2019 | Raymond et al. |

* cited by examiner

BALL TRANSFER MECHANISM WITH POLYCRYSTALLINE DIAMOND BEARING SUPPORT

CROSS-REFERENCE TO RELATED APPLICATIONS

This is a divisional of U.S. patent application Ser. No. 15/726,506, which was filed on Oct. 6, 2017, entitled "BALL TRANSFER MECHANISM WITH POLYCRYSTALLINE DIAMOND BEARING SUPPORT", which is hereby incorporated herein by reference in its entirety.

STATEMENT REGARDING FEDERALLY SPONSORED RESEARCH OR DEVELOPMENT

This invention was developed under Contract No. DE-NA0003525 between the United State Department of Energy and National Technology & Engineering Solutions of Sandia, LLC, for the operation of the Sandia National Laboratories.

BACKGROUND OF THE INVENTION

The present invention relates to the field of drilling, and specifically to a ball transfer assembly for a high temperature downhole motor.

Downhole drills are used for oil drilling, geothermal drilling, and other deep earth penetration applications. Downhole drills include rotary and percussive drills. For nearly any drilling method, rotational energy must be transferred downhole in order to promote rock reduction. The drill bit may be rotated by an electric motor or fluid/hydraulic system. The rotating action can be produced either at the surface or near the drill bit. In addition to rotational cutting, drills may also be pressurized or mechanically actuated to force the drill bit to hammer against the rock/earth. Prior art rotation systems and methods are complex, require large form factors to create sufficient torque, and require a high degree of maintenance.

The most common method of downhole energy transfer is rigid drill pipe. The drill pipe is rotated from the surface, with drilling joints added for tripping (moving in and out of the hole). For this type of system, the entire drill string rotates. Typically, a rotary table system or a top drive is used to drive the drill string. Although it is well suited for vertical drilling, it has limited applications in directional drilling because the drill string curvature and thrust loads generate additional torque that the surface based motor must overcome and drill pipe survive.

Downhole techniques used to generate rotation such as positive displacement motors (PDMs) are limited in their temperature range due to the use of elastomers. Energy resources like geothermal and deep oil and gas wells lie in hot (160° C.-300° C.), and often hard rock. The high-temperatures limit the use of PDM's in those environments. In addition, PDMs generate rotation by eccentric motion of the rotor around the motor case which induces significant lateral vibration to the drilling assembly.

U.S. Pat. No. 9,447,798 discloses a motor that includes a module assembly incorporating an axially-cycled piston. The piston axial motion is torque coupled to convert the axial motion into rotary motion. The method does not require elastomers for operation and the rotor operates concentrically thereby not inducing lateral vibration. A modular fluid powered linear piston motor with harmonic coupling is described in U.S. patent application Ser. No. 15/090,282 filed Apr. 4, 2016, entitled "Modular Fluid Powered Linear Piston Motors with Harmonic Coupling", and includes a drive train to convert reciprocating motion from a piston into rotary motion in an output shaft. Rotation is accomplished with roller balls captured between an inner race and a drive liner to facilitate rotation between a rotor and a stator. These roller balls must operate with low friction to enable smooth operation of the motor. Additionally, they must operate under a high contact load as they are in the preloaded and active load path to transmit torque to the output rotor. Finally, they must potentially operate with an abrasive drilling fluid under the rigors of high ambient temperatures and high friction conditions.

What is needed is a system and/or method that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY OF THE INVENTION

One embodiment relates to a ball transfer mechanism. The ball transfer mechanism includes a spherical ball and a cylindrical seat portion. The seat portion defines a hemispherical shaped recess with a contour for receiving the ball. The ball transfer mechanism is disposed within an exterior wall of a hollow cylindrical housing for converting rotary motion to linear motion, driving a linear piston motor disposed within the housing.

Another embodiment relates to a harmonic drive member for driving a rotor of a linear piston motor. The harmonic drive member includes a hollow cylindrical coupler portion engaging a rotor portion for transferring torque to the rotor portion. Ball transfer mechanisms disposed along a housing wall of the linear piston motor are engageable with the coupler portion. The coupler portion includes harmonic cam grooves for receiving spherical balls in the ball transfer mechanism. A mutual reaction between the ball transfer mechanisms and the harmonic cam grooves drives axially linear movement of the drive portion and generates a torque to rotate the rotor portion.

A further embodiment relates to a linear piston motor for drilling. The linear piston motor includes a rotor portion axially positioned within a housing portion. The rotor portion includes pistons in sealed engagement with an inner wall of the housing. The pistons apply hydraulic pressure in a linear direction of flow. A harmonic drive is positioned axially within the housing. The harmonic drive has a hollow cylindrical coupler portion engaging the rotor portion for transferring torque to the rotor portion, and ball transfer mechanisms engageable with the respective coupler portion.

One advantage is a drilling system configured with a ball transfer device against which the rotor may react. The harmonic drive and piston interaction are provided by a ball transfer apparatus in a ball support. A tungsten carbide supported polycrystalline diamond (PCD) bearing is created, wherein the ball transfer resides within the diamond seat.

Another advantage is that friction between diamond and steel is low (i.e., friction coefficient of 0.1). Hence, the ball in the ball transfer rotates easily on the diamond seat.

Another advantage is that operational forces are carried via contact loads between the ball transfer, the ball, and the coupler having preferred values of elasticity and compressive strength. Hence, a tungsten carbide ball or comparable material can be used as the ball transfer for improved performance for this application.

A further advantage of the disclosed ball transfer apparatus is, since the ball may rotate in any required direction, rolling contact exists between the ball and the harmonic drive. Therefore, with rolling contact the ball transfer does not wear as fast.

Alternative exemplary embodiments relate to other features and combinations of features as may be generally recited in the claims.

BRIEF DESCRIPTION OF THE DRAWINGS

The application will become more fully understood from the following detailed description, taken in conjunction with the accompanying figures, wherein like reference numerals refer to like elements, in which.

DETAILED DESCRIPTION OF THE INVENTION

Before turning to the figures which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Figure 1:
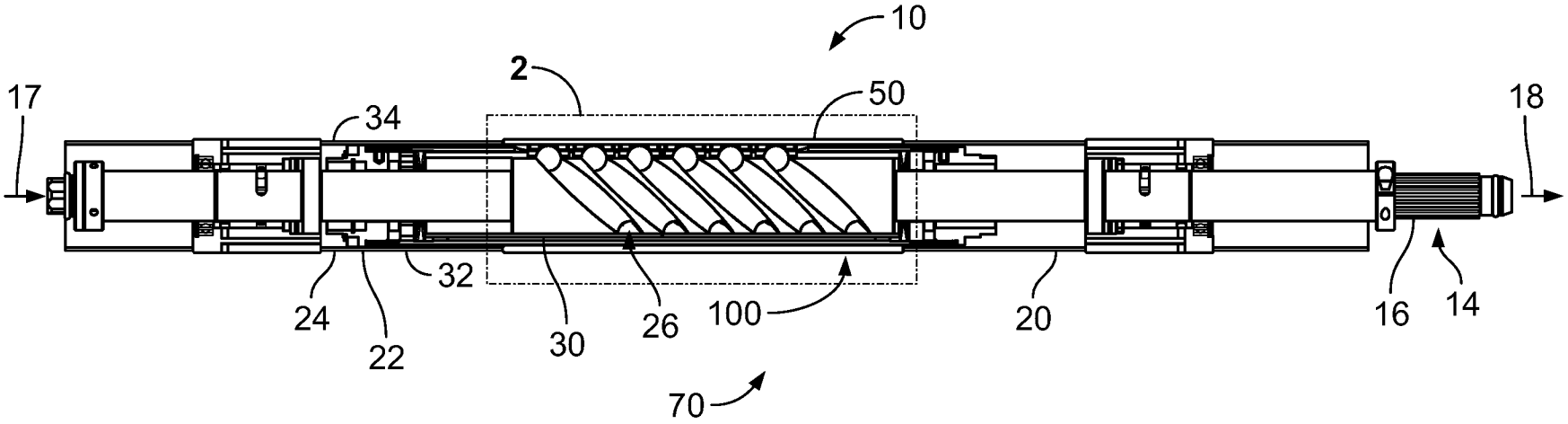
FIG. 1 shows a cross-sectional view of an exemplary fluid powered linear piston motor of the present invention.
Figure 2:
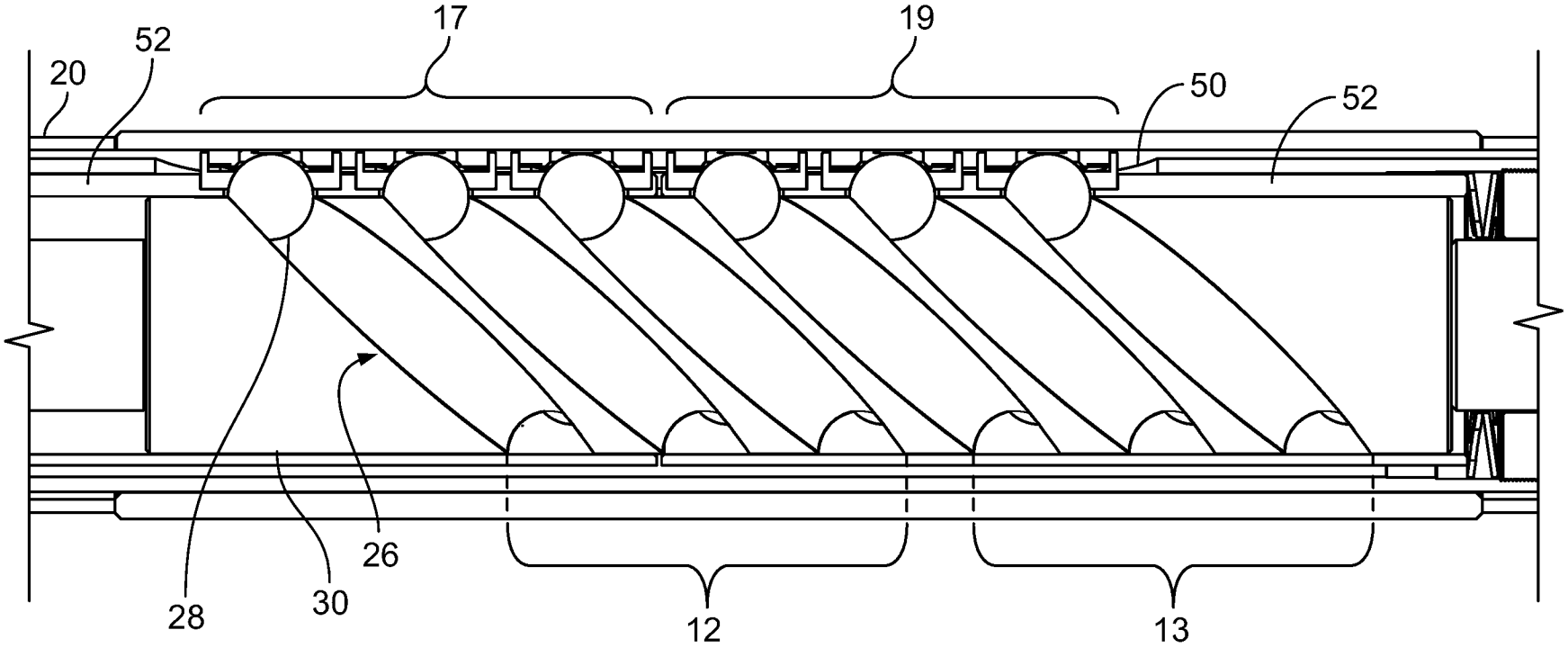
FIG. 2 shows a cross-sectional detail of a drive member with a ball transfer member.

Referring to FIG. 1, a fluid powered linear motor 100 is shown. A rotor 14 is axially positioned within an exterior housing 20 with pistons 22 in sealed engagement with inner housing wall 24 for applying hydraulic pressure in a linear direction of flow. Harmonic drive 10 includes a hollow cylindrical coupler 30 with an internal splined surface (not shown), for engagement with splines 16, and for transferring torque to rotor 14. Coupling 30 includes harmonic cam grooves 26 having semicircular cross sections for receiving spherical balls 28 (see FIG. 2). Drive ball retainers 52 are installed over cylindrical coupler 30 with openings that match axial location of harmonic cam grooves 26 to receive installation of ball transfer assemblies (See FIG. 3). A ring 50 with an external splined surface for reacting torque to the housing 20 is installed concentric with the drive ball retainers 52 and mated with pistons 22 and drive ball retainer nut and spring 32 at its ends. The drive ball retainers 52 include first and second harmonic drive tracks 12, 13 that are preloaded to enable bi-directional cycling of the piston 22 and ring assembly 50 and introduction of torque to the rotor 14 via rotation of the harmonic drive 30.

A pressure chamber 34 is formed between piston 22 and cylinder wall 24. A pressurized fluid 17 may enter the pressure chamber and be available to be discharged outside of the rotor housing through pressure ports and collected through exhaust ports into an exhaust chamber to be exhausted from the rotor housing 18.

FIG. 1 shows a modular assembly for the linear piston motor 100 according to an embodiment of the disclosure. The module assemblies 70 convert a piston action into a rotary motion; an adjacent serial & clocked module (not shown) may be used to generate continuous rotational motion in an output rotor 14 while the piston comprising module 70 is reversing its motion. The module assembly 100 may include a cylindrical coupler 30, a piston assembly 22, a first ball transfer member 17 and a second ball transfer member 19. Reciprocation of the ring assembly 50 directly rotates cylindrical coupler 30 through engagement with ball transfer assemblies 17, 19. The ring assembly 50 is disposed upon the cylindrical coupler 30 such that the cylindrical coupler 30 may freely rotate within the motor housing 20. Balls 28 roll within channels 26 while maintaining a fixed linear position within ball transfer assemblies 17, 19, as further described below.

Figure 3:
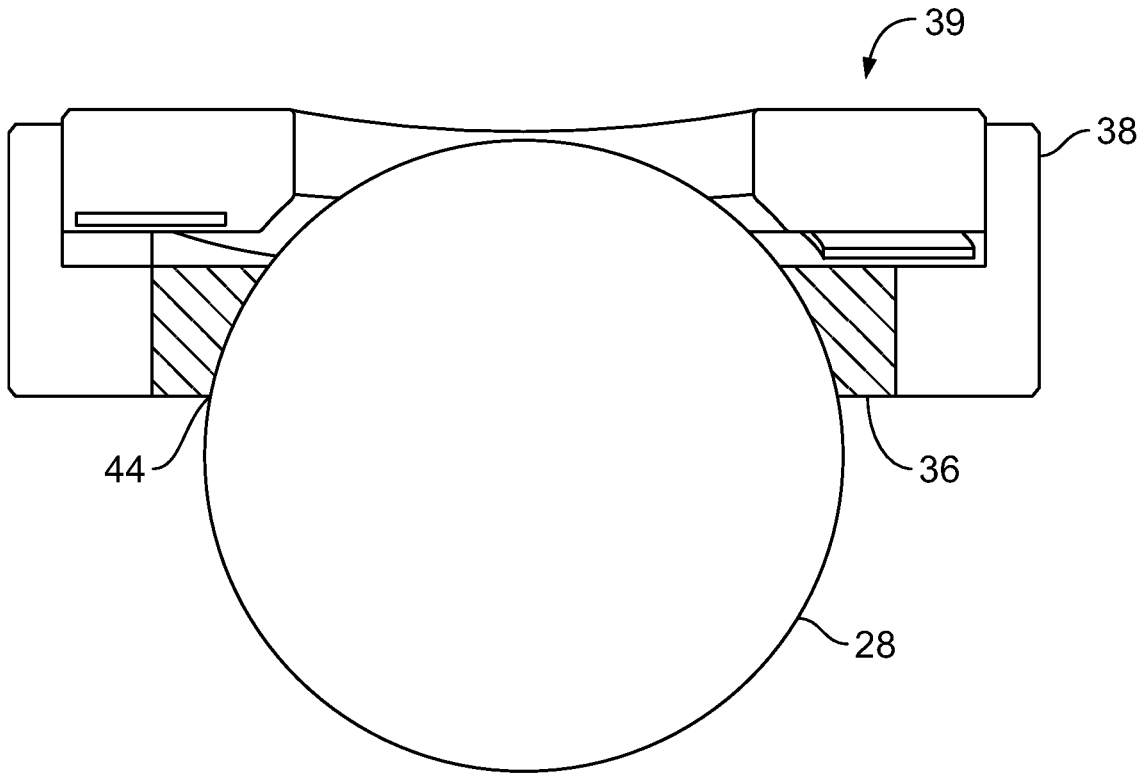
FIG. 3 shows an exemplary PCD bearing ball transfer member.

Referring next to FIG. 3, ball 28 may preferable be made of a hard material, e.g., tungsten carbide, steel or similar metal or ceramic balls. In an embodiment the seat portion 36 of a ball transfer assembly 39 may be a cylindrical blank having a tungsten carbide outer layer 38 and a polycrystalline diamond, or PCD, core 42 for maximum hardness and wear suitable for the extreme heat and pressure associated with the downhole drill motor. Seat portion 36 includes a hemispherical recess 44 with a contour for receiving ball 28.

Figure 4:
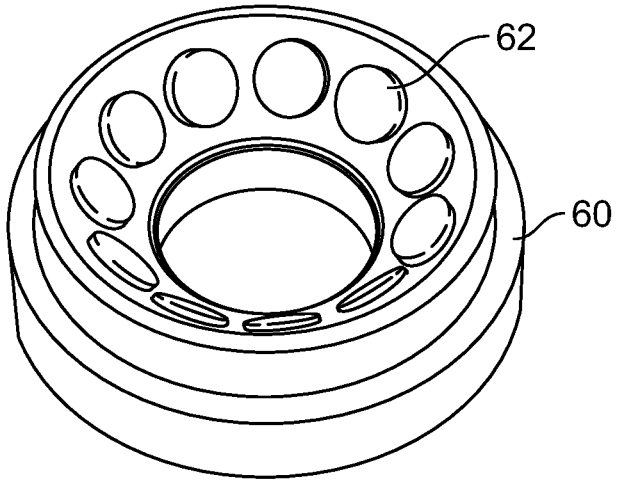
FIG. 4 shows a spherical bearing constructed of individual polycrystalline diamond inserts used to support the ball in the transfer member.

In one embodiment, ball transfer assembly 39 may be made from PCD dies, wherein the PCD is a synthetic material produced by sintering diamond powder in the presence of a metal catalyst under extreme heat and pressure to fuse the diamond particles together. With a diamond seat portion 36, the ball rotates easily with reduced friction. In an alternate embodiment, a spherical bearing 60 (as shown in FIG. 4) constructed of individual polycrystalline diamond inserts 62 (See FIG. 4) may be used to support the ball 28.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the ball transfer with PCD bearing support, as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

The invention claimed is:

1. A harmonic drive member for driving a rotor of a linear piston motor comprising:

a hollow cylindrical coupler portion engaging a rotor portion for transferring torque to the rotor portion; at least one ball transfer mechanism engageable with the coupler portion;

the coupler portion comprising at least one harmonic cam groove for receiving at least one spherical ball; wherein mutual reaction between the at least one ball transfer mechanism and the at least one harmonic cam groove axial linear movement of the drive portion generates a torque to rotate the rotor portion;

wherein the hollow cylindrical coupler portion comprises an internal splined surface, and the rotor portion comprises splines for engaging the coupler portion for transferring torque from the coupler portion to the rotor portion.

2. The drive member of claim 1, wherein the ball comprises a hard metal material.

3. The drive member of claim 1, wherein the seat portion comprises a hard metal outer layer and a polycrystalline core portion.

4. The drive member of claim 3, wherein the hard metal is tungsten carbide.

5. The drive member of claim 1, wherein the ball is comprised of steel or metal balls of comparable hardness.

6. The drive member of claim 1, wherein the seat portion comprises a material configured for maximum hardness and wear suitable to withstand extreme heat and pressure associated with a downhole drill motor.

7. A linear piston motor for drilling comprising:

a rotor portion axially positioned within an annular housing portion;

the rotor portion comprising one or more pistons in sealed engagement with an inner wall of the housing;

the pistons configured to apply hydraulic pressure in a linear direction of flow;

a harmonic drive positioned coaxially within the housing;

the harmonic drive comprising a hollow cylindrical coupler portion engaging the rotor portion for transferring torque to the rotor portion; and at least one ball transfer mechanism engageable with the respective coupler portion;

wherein the hollow cylindrical coupler portion comprises an internal splined surface, and the rotor portion comprises splines for engaging the coupler portion for transferring torque from the coupler portion to the rotor portion.

8. The linear piston motor of claim 7, wherein the coupler portion comprises at least one harmonic cam groove for receiving at least one spherical ball.

9. The linear piston motor of claim 7, wherein the at least one ball transfer mechanism comprises a spherical ball and a cylindrical seat portion defining a hemispherical recess for receiving the ball in rolling contact therewith.

10. The linear piston motor of claim 7, wherein the harmonic drive portions are configured with a preload in opposing directions to enable bi-directional cycling of the piston assembly.

11. The linear piston motor of claim 7, wherein the seat portion comprises a tungsten carbide outer layer and a polycrystalline diamond core portion.

12. The linear piston motor of claim 7, wherein the ball transfer mechanism is configured to impart torque to the coupler portion for driving the rotor portion, wherein rotation of the rotor housing directly rotates the cylindrical coupler by engagement of the harmonic cam grooves with the ball interaction with the polycrystalline diamond core.

13. The linear piston motor of claim 12, wherein the grooves comprise a semicircular cross section for receiving hemispherical ball.

* * * * *